US009015972B1

(12) United States Patent
Morgan

(10) Patent No.: US 9,015,972 B1
(45) Date of Patent: Apr. 28, 2015

(54) VEHICLE ADVERTISING SYSTEM

(71) Applicant: Russ Bryan Morgan, Davie, FL (US)

(72) Inventor: Russ Bryan Morgan, Davie, FL (US)

( * ) Notice: Subject to any disclaimer, the term of this patent is extended or adjusted under 35 U.S.C. 154(b) by 0 days.

(21) Appl. No.: 14/257,975

(22) Filed: Apr. 21, 2014

Related U.S. Application Data

(60) Provisional application No. 61/813,981, filed on Apr. 19, 2013.

(51) Int. Cl.
*G09F 21/04* (2006.01)
*G09F 13/18* (2006.01)
*G09F 13/22* (2006.01)

(52) U.S. Cl.
CPC ..... *G09F 21/048* (2013.01); *G09F 13/18* (2013.01); *G09F 2013/1881* (2013.01); *G09F 2013/222* (2013.01)

(58) Field of Classification Search
CPC . B60Q 1/56; G09F 2007/1895; G09F 21/048; G09F 21/04; G09F 7/18; B60R 13/10; B60R 13/105
USPC ..... 40/209, 210, 204, 200, 590, 591
See application file for complete search history.

(56) References Cited

U.S. PATENT DOCUMENTS

| | | | | |
|---|---|---|---|---|
| 1,950,322 | A * | 3/1934 | Newby | 40/200 |
| 3,908,296 | A * | 9/1975 | Harrison | 40/210 |
| 5,027,537 | A * | 7/1991 | Freeman et al. | 40/210 |
| 5,878,516 | A * | 3/1999 | Amirian | 40/591 |
| 6,582,314 | B1 * | 6/2003 | Arehart | 472/51 |
| 6,796,060 | B1 * | 9/2004 | Meester et al. | 40/210 |
| 2009/0064552 | A1 * | 3/2009 | Columbia | 40/591 |

* cited by examiner

*Primary Examiner* — Casandra Davis
(74) *Attorney, Agent, or Firm* — Nancy J. Flint, Esq.; Nancy J. Flint, Attorney At Law

(57) ABSTRACT

Mobile signs/billboards designed to attach to the back end of a vehicle are disclosed comprising a mounting device that is mounted to the back end of a vehicle via the holes for fixing a license plate, and a sign or billboard supported by the mounting device. The signs are designed in a variety of shapes and sizes to provide a display for advertisement or personal messaging. The sign/billboard can be inserted or removed quickly from the mounting device. While the sign/billboard is supported by the mounting device at the back end of the vehicle, the license tag is affixed elsewhere on the mounting device for full viewing and lighting. The mounting device remains on the vehicle until easily removed whereupon the license plate can be reattached to the vehicle. The mounting device comprises an inner pocket for easy insertion and removal of signs and billboards. Lighting may be wired with the vehicle or use solar power or batteries to providing lighting for the sign/billboard.

5 Claims, 14 Drawing Sheets

VEHICLE ADVERTISING SYSTEM

RELATED APPLICATIONS

This application is a non-provisional application of U.S. Provisional Patent Appln. Ser. No. 61/813,981 filed on Apr. 19, 2013 and titled LIGHTED VEHICLE ADVERTISING SYSTEM, the contents of which are incorporated by reference in its entirety.

FIELD OF INVENTION

The invention generally relates to the field of mobile signs/billboards designed to attach to the back end of a vehicle. More particularly, the invention comprises a mounting device that is mounted to the back end of a vehicle via the holes for fixing a license plate, and a sign or billboard supported by the mounting bracket. The signs are designed in a variety of shapes and sizes to provide a display for advertisement. The sign/billboard can be inserted or removed quickly from the mounting device by way of safety clips that mate with the license plate fixation holes. While the sign/billboard is supported by the mounting device at the back end of the vehicle, the license tag is affixed elsewhere on the mounting device for full viewing and lighting. The mounting device remains on the vehicle until easily removed whereupon the license plate can be reattached to the vehicle. The mounting device comprises an inner pocket for easy insertion and removal of signs and billboards. Lighting may be wired with the vehicle or use solar power or batteries to providing lighting for the sign/billboard.

BACKGROUND OF THE INVENTION

In tough economic times, individuals and business owners alike are becoming creative in the way they spend their advertising dollars. People and businesses have used their vehicles in advertising their businesses for years. Typically, advertisements have been placed on the sides and top of the vehicles. The back of the vehicle however is the most viewed. With lights and contouring designs, the back of the vehicle leaves little area to connect something. Taxi cabs have for years carried advertising on trunks and the roofs of their vehicle, but everyday vehicles do not want the added stress of big clunky systems.

Trailer hitch signs are becoming more prevalent. People are installing trailer hitches to their vehicle so that they can pull a trailer with a billboard attached. They also are using a board that attaches to the hitch. This requires that the vehicle have a trailer hitch which can be expensive and in some cases requires alteration of the car. Additionally, vehicle owners sometimes do not want the look of a trailer hitch on their vehicle. A sign attached to a trailer hitch is often extremely heavy as well which makes installing and removing the sign a considerable chore.

Magnets are another form of placing a message on a vehicle. They are typically placed on the side panels of vehicles but once again there is not room for any sizeable magnet. Additionally many vehicles manufactured today are non-magnetic. When magnets are removed they must be stored in the flat position or they become permanently bent, thus allowing air to flow behind the sign when it is placed on the side panel and at times causing the magnet to fly causing a dangerous situation.

Wrap advertising or a vehicle wrap is a marketing practice of completely or partially covering (wrapping) a vehicle in an advertisement made of large pressure-sensitive vinyl sheets.

The cost of a full vehicle wrap can exceed $2500.00. Some jurisdictions have placed restrictions and even bans on wrap advertisements.

U.S. Pat. No. 6,381,886, issued May 7, 2002 to Fo Chou, discloses a license plate mounted display comprising a first mounting bracket with holes spaced for attaching to a license plate on a vehicle; an arm attached to the first mounting bracket; a first snap buckle attached to an outer end of the arm; a display panel having a lower edge attached to a second mounting bracket; a second snap buckle attached to the second mounting bracket; and a display panel attached to the vehicle by connecting the first and second snap buckles together. The display panel is detached or replaced by disconnecting the snap buckles. In one embodiment, a flag is attached to a third snap buckle that is detachably connected to the first snap buckle.

U.S. Pat. No. 6,247,257, issued Jun. 19, 2001 to Jon R. Powell, discloses a display plate attachable to a rear of an automobile comprising a kit for mounting a message display plate on the rear bumper of a vehicle without using adhesives or other permanent mounting means. In one embodiment, the message display plate is secured to a vehicle ball-type trailer hitch or bumper by means of a top tab which extends laterally from the front surface of the display plate wherein a threaded post of the trailer hitch tow ball is passed through a hole in the tab and the tow ball post is then threadably secured in a hole in the trailer hitch tongue or vehicle bumper using a tow ball nut. In another embodiment, the display plate is secured to the top or bottom of a standard vehicle license plate attachment point by means of two bottom tabs with holes whose spacing corresponds to those of a standard license plate using the same screws to secure the license plate and orienting the display plate such that it is located directly above or directly below the vehicle license plate. In a third embodiment, the display plate is mounted in a square receiver socket of a vehicle trailer hitch. A tubular element having a square cross-section to match the interior shape of the receiver socket is mounted to the front surface of the display plate using an appropriate adhesive or other coupling and extends perpendicularly from the front of the display plate to slidably mate with the receiver. Corresponding bore holes within both the tubular element and the receiver are aligned to accept a cylindrical pin to securely mate the display plate with the trailer hitch.

U.S. Pat. No. 5,878,516, issued Mar. 9, 1999 to Partev Amirian, discloses a vehicle billboard fixedly mounted to a supporting frame having a flat surface upon which a design may be affixed, drawn or otherwise displayed. A pair of brackets join the supporting frame and billboard to a license plate frame via screws or rivets.

U.S. Pat. No. 1,575,950, issued Mar. 9, 1926 to Lawrence T. Thorn, discloses a license and identification card holder for motor vehicles in the form of a U-shaped open, frame member constructed of suitable sheet metal of U-shape in cross section to provide a channel for receiving the edges of the license plate. When assembled, the device reduces the liability of tampering with the tag or identification card in the event of the vehicle being stolen.

SUMMARY OF THE INVENTION

A vehicle advertising system is disclosed in which a mounting device is attached to the back of a vehicle using a mounting bracket that attaches to the holes for fixing a license plate, and a sign or billboard supported by the mounting device. The mounting device attaches via bolts to the 2 or 4 holes provided in the vehicle by the manufacturer. The signs vary in size and shapes. When the mounting device is attached, the license plate is relocated to another part of the mounting device where it remains viewable as required by law. The mounting device is designed so it does not cover brake lights or obstruct the driver's rear view. The mounting device can be easily removed and the license tag can be reattached directly to the vehicle. The signs/billboards can range from 12 in.×12 in. up to 40 in.×60 in.

The vehicle advertising system can be configured to provide illumination of the sign using solar and/or battery back-up power making it visible at all times whether parked or while the vehicle is moving. The vehicle advertising system can also be wired into the electrical system of the vehicle to provide illumination.

BRIEF DESCRIPTION OF DRAWINGS

The invention will be described with reference to the accompanying drawings, in which like elements are referenced with like numerals.

DETAILED DESCRIPTION OF THE INVENTION

A vehicle advertising system is disclosed in which a mounting device is attached to the back of a vehicle using a mounting bracket that attaches to the holes for fixing a license plate, and a sign or billboard supported by the mounting device. The mounting bracket attaches via bolts to the 2 or 4 holes provided in the vehicle by the manufacturer. When the mounting device is attached, the license plate is relocated to another part of the mounting device where it remains viewable as required by law. This mounting device is designed so it does not cover brake lights or obstruct the driver's rear view. A sign or billboard can easily be attached to the mounting device and easily removed whereupon the license tag can be reattached to the vehicle. The signs/billboards can range from 12 in.×12 in. up to 40 in.×60 in. and have a variety of shapes and sizes.

The vehicle advertising system can be configured to provide illumination of the sign using solar and/or battery back-up power making it visible at all times whether parked or while the vehicle is moving. The vehicle advertising system can also be wired into the electrical system of the vehicle to provide illumination.

By using the vehicle advertising system of the invention, every vehicle on the road can have an advertising lighted display on the back of their vehicle. It can also serve to have non advertising uses such as personal messages, pictures or displays.

Figure 1A:
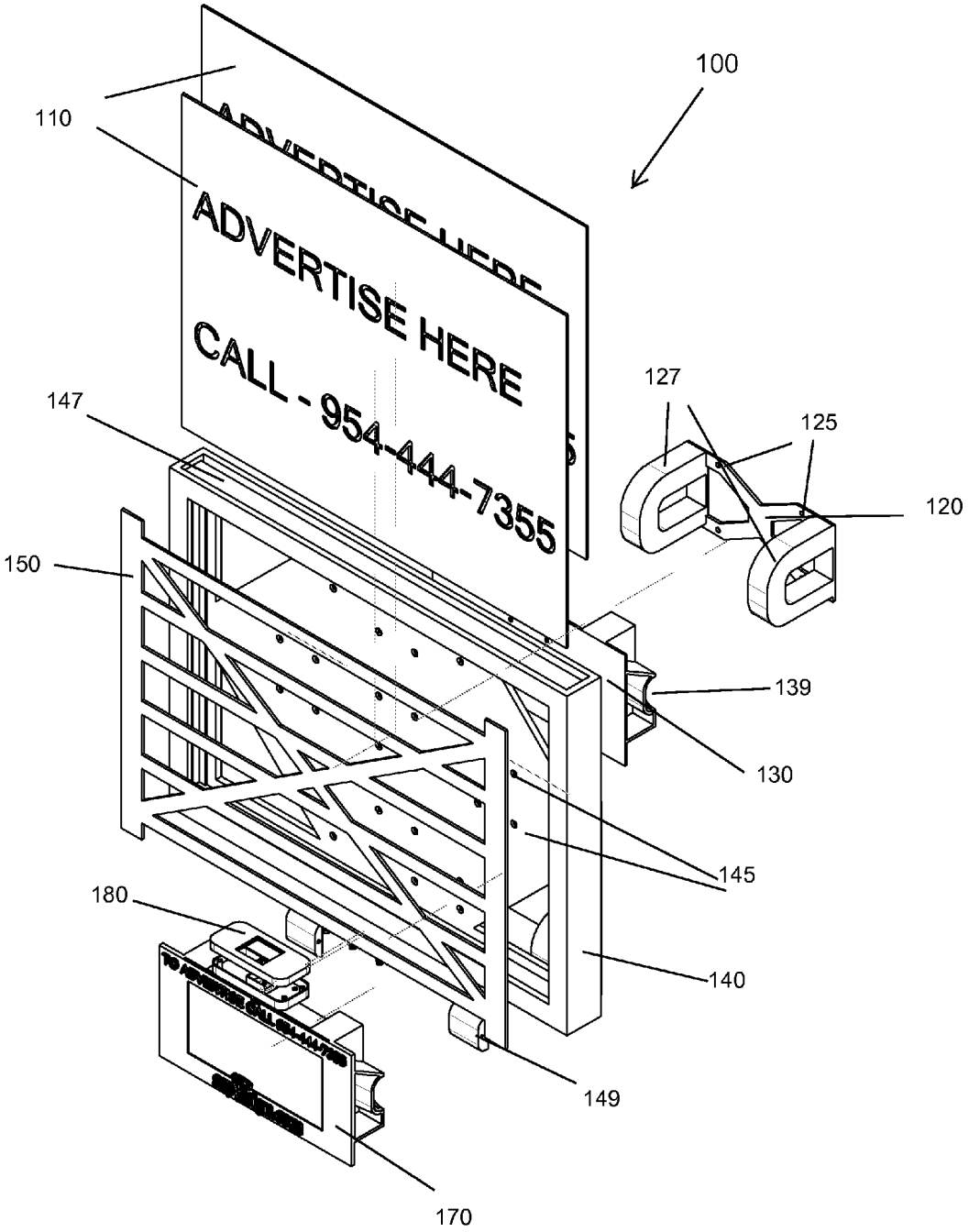
FIG. 1A is an exploded front perspective view of the mounting device including a sign according to one embodiment of the invention.

Turning to the figures, FIG. 1A is an exploded front perspective view of a mounting device 100 including a sign 110 according to one embodiment of the invention. Mounting device comprises mounting bracket 120 having a plurality of mounting bracket holes 125 aligned with holes in a vehicle for mounting a license plate. Mounting bracket 120 is attached to the holes in the vehicle for mounting a license plate by way of screws inserted through mounting bracket holes 125. Mounting bracket 120 further comprises two mounting arms 127. Mounting device 100 further comprises sign mounting bracket 130 having a plurality of sign mounting bracket holes 135, two sign mounting bracket receiving cavities 137 sized to receive mounting bracket arms 127 and two sign mounting bracket attachment cavities 139. Mounting bracket 110 further comprises sign frame 140 comprising a plurality of sign frame holes 145 and four quick connectors 149. Mounting bracket 100 further comprises LED lighting frame 150 and license plate mounting bracket 160. License plate mounting bracket 160 comprises a plurality of holes 165 and two license plate mounting quick connectors 167. Mounting device 100 further comprises license plate holder 170 which comprises two license plate mounting bracket receiving cavities 177 sized to receive mounting bracket arms 127 and also two license plate holder attachment cavities 179. Solar power unit 180 is disposed on license plate holder 170.

Figure 1B:
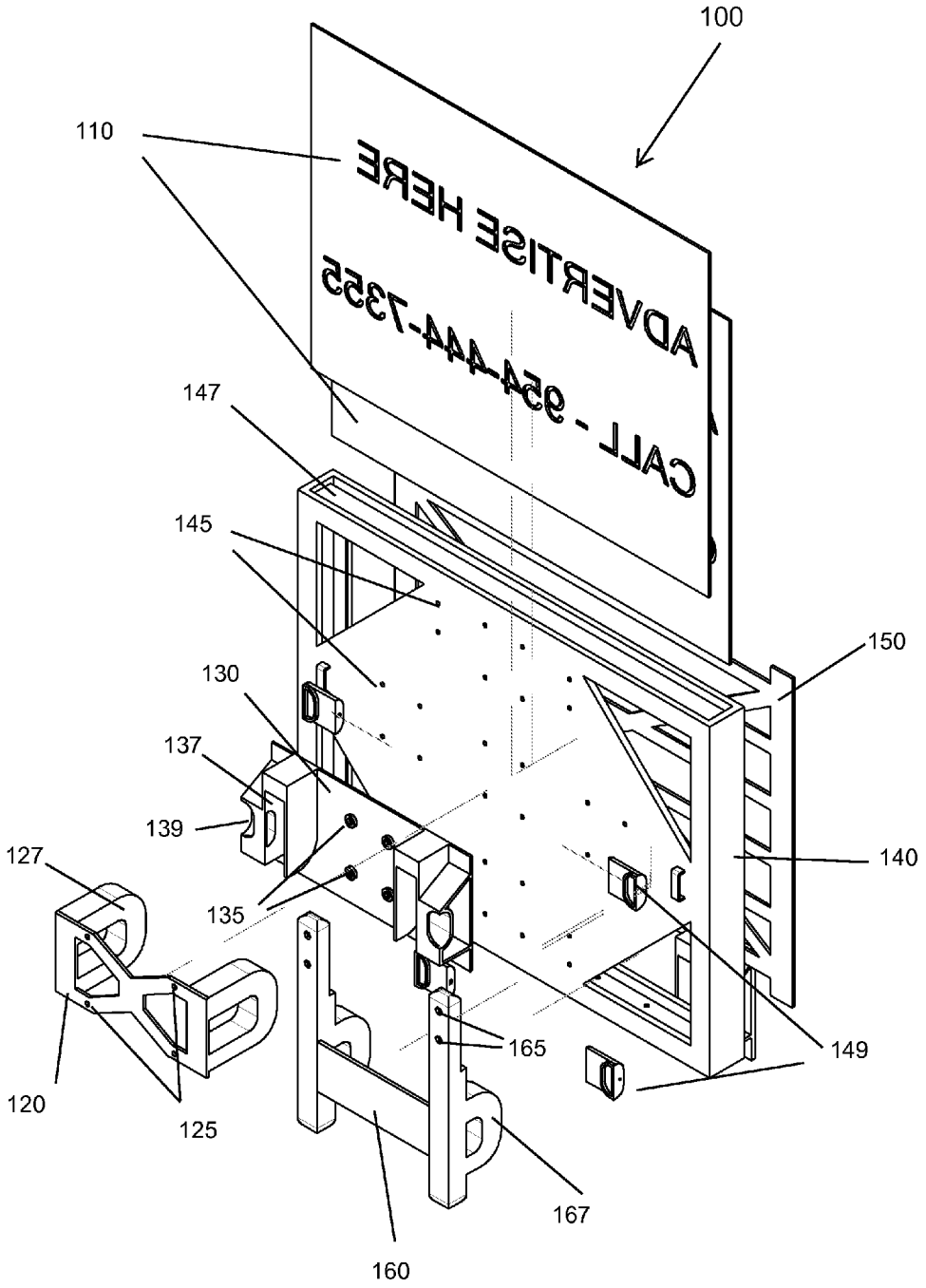
FIG. 1B is an exploded rear perspective view of the mounting device including a sign according to one embodiment of the invention.

FIG. 1B is an exploded rear perspective view of the mounting device 100 including a sign 110 as seen in FIG. 1A.

Figure 2A:
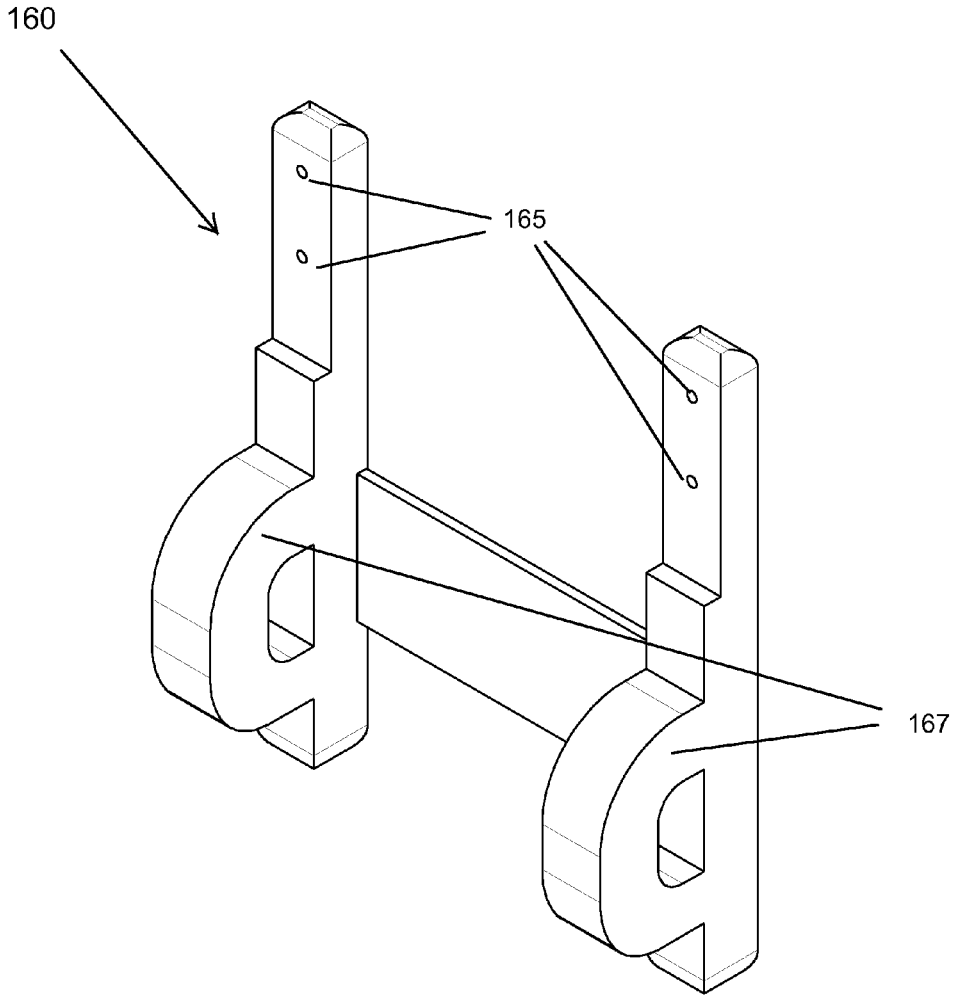
FIG. 2A is a front perspective view of the license plate bracket for attachment to the mounting device to according to one embodiment of the invention.

FIG. 2A is a front perspective view of license plate mounting bracket 160 showing license plate mounting bracket holes 165 and license plate mounting bracket arms 167.

Figure 2B:
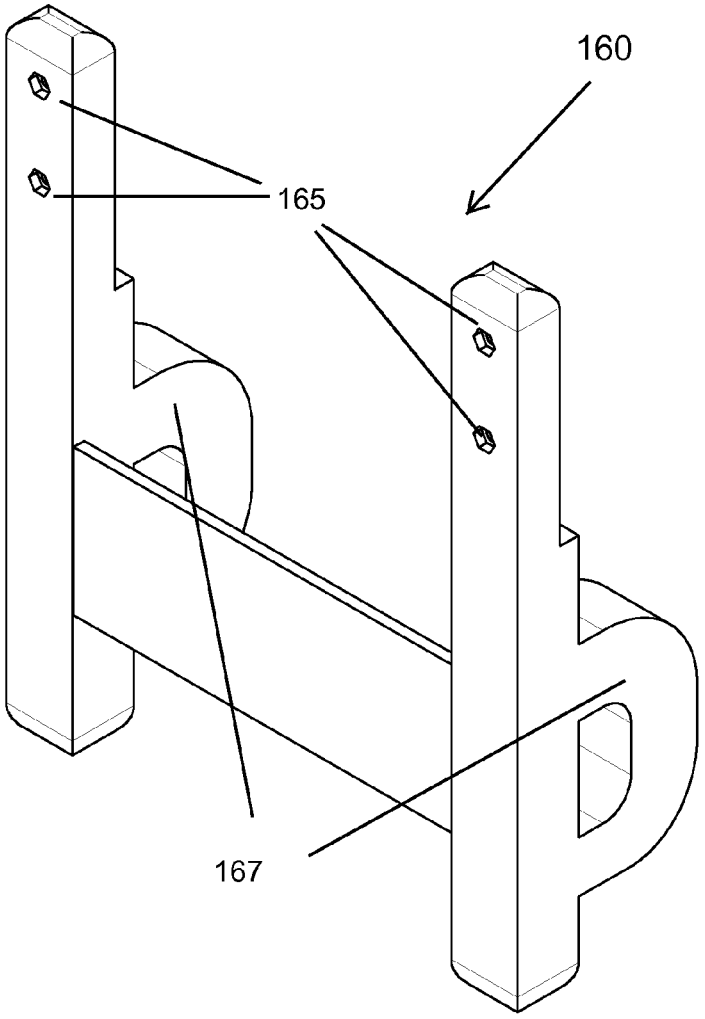
FIG. 2B is a rear perspective view of the license plate bracket for attachment to the mounting device to according to one embodiment of the invention.

FIG. 2B is a rear perspective view of license plate bracket 160 showing license plate mounting bracket holes 165 and license plate mounting bracket arms 167.

Figure 3A:
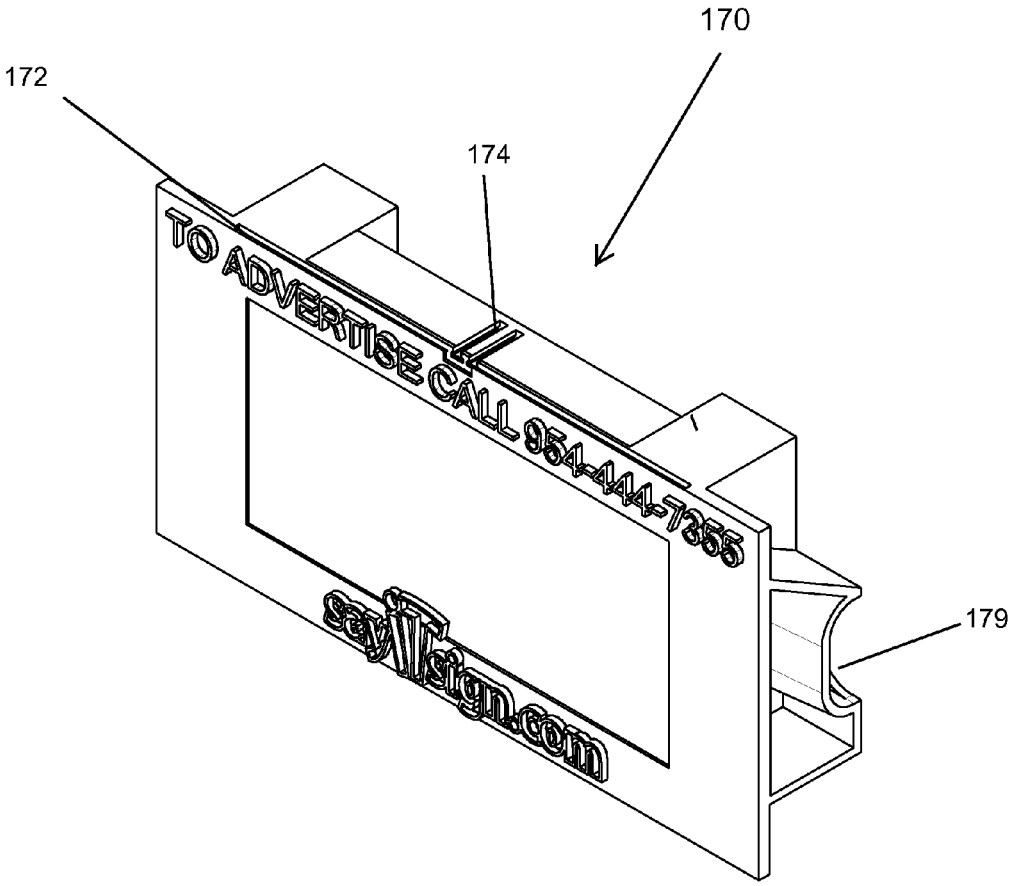
FIG. 3A is a front perspective view of the license plate holder for attachment to the license plate bracket according to one embodiment of the invention.

FIG. 3A is a front perspective view of license plate holder 170 comprising license plate holder receiving cavities 177. License plate holder 170 further comprises sleeve 172 for insertion of a license plate. License plate holder 170 further comprises a clip 174 for holding a solar power unit 180 for providing power to light up the license plate holder 170.

Figure 3B:
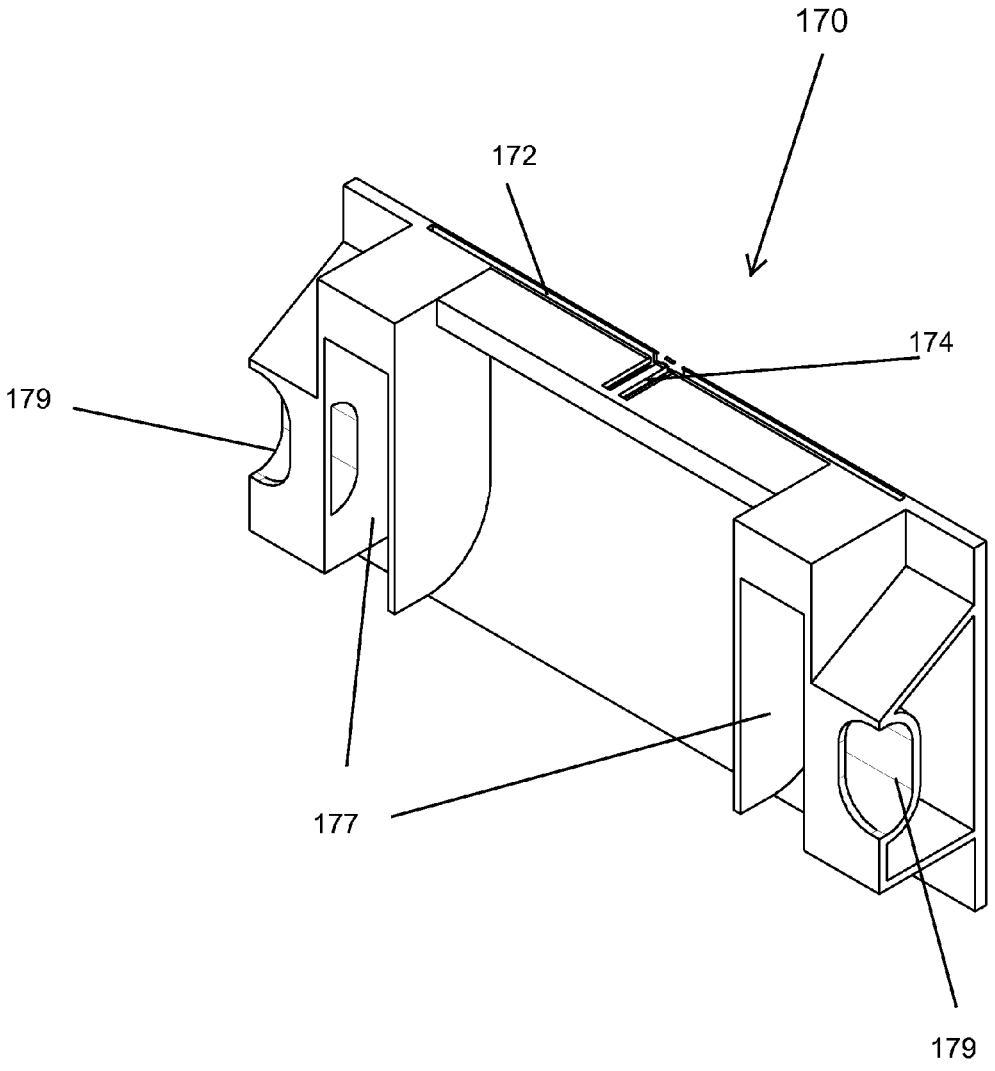
FIG. 3B is a rear perspective view of the license plate holder for attachment to the license plate bracket according to one embodiment of the invention.

FIG. 3B is a rear perspective view of license plate holder 170 comprising license plate holder receiving cavities 177.

Figure 4A:
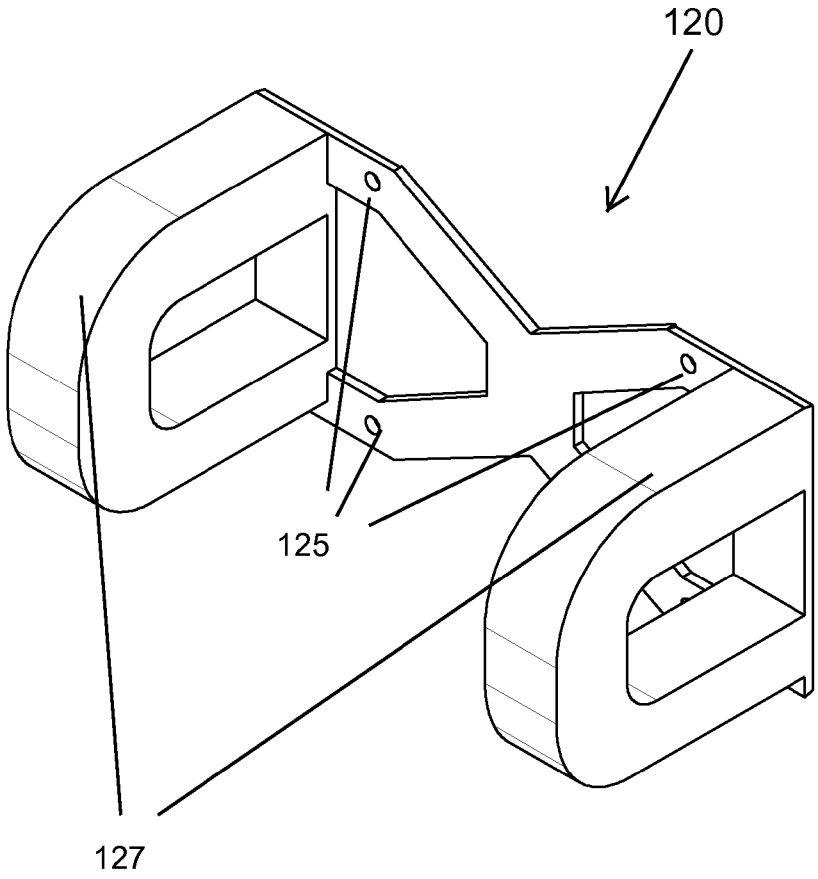
FIG. 4A is a front perspective view of a mounting bracket according to one embodiment of the invention.

FIG. 4A is a front perspective view of mounting bracket 120 comprising mounting bracket holes 125 and mounting bracket mounting arms 127.

Figure 4B:
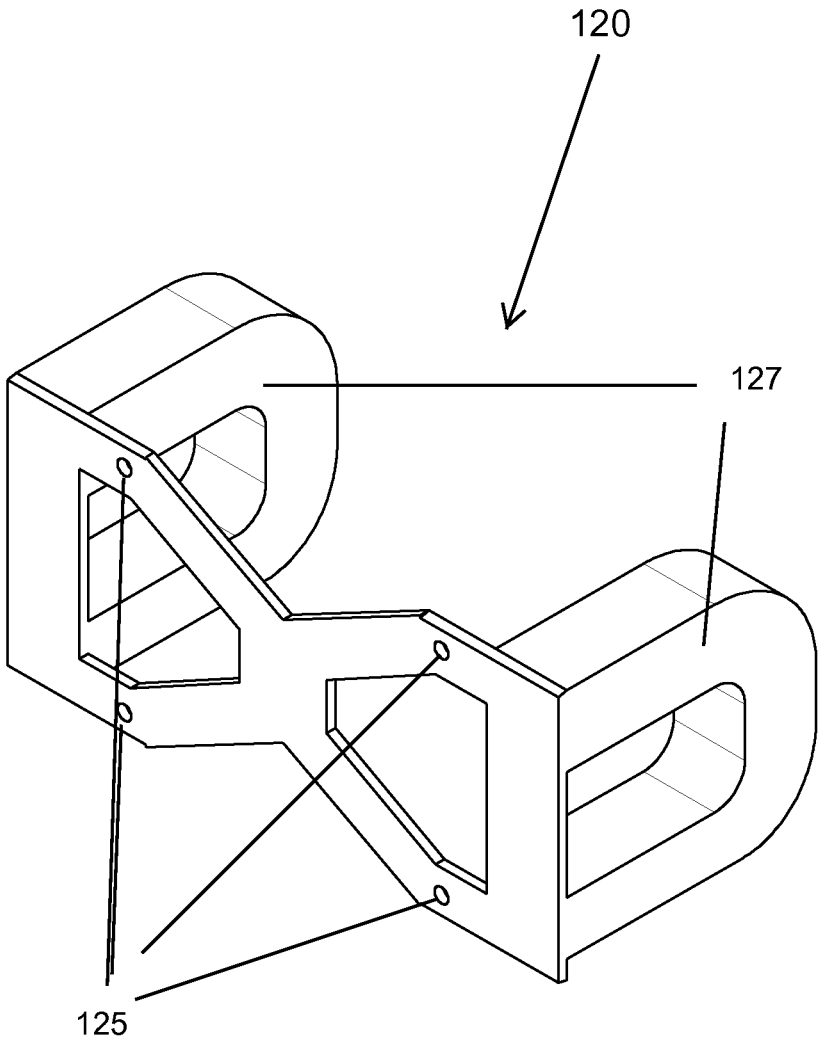
FIG. 4B is a rear perspective view of a mounting bracket according to one embodiment of the invention.

FIG. 4B is a rear perspective view of mounting bracket 120 comprising mounting bracket holes 125 and mounting bracket mounting arms 127.

Figure 5A:
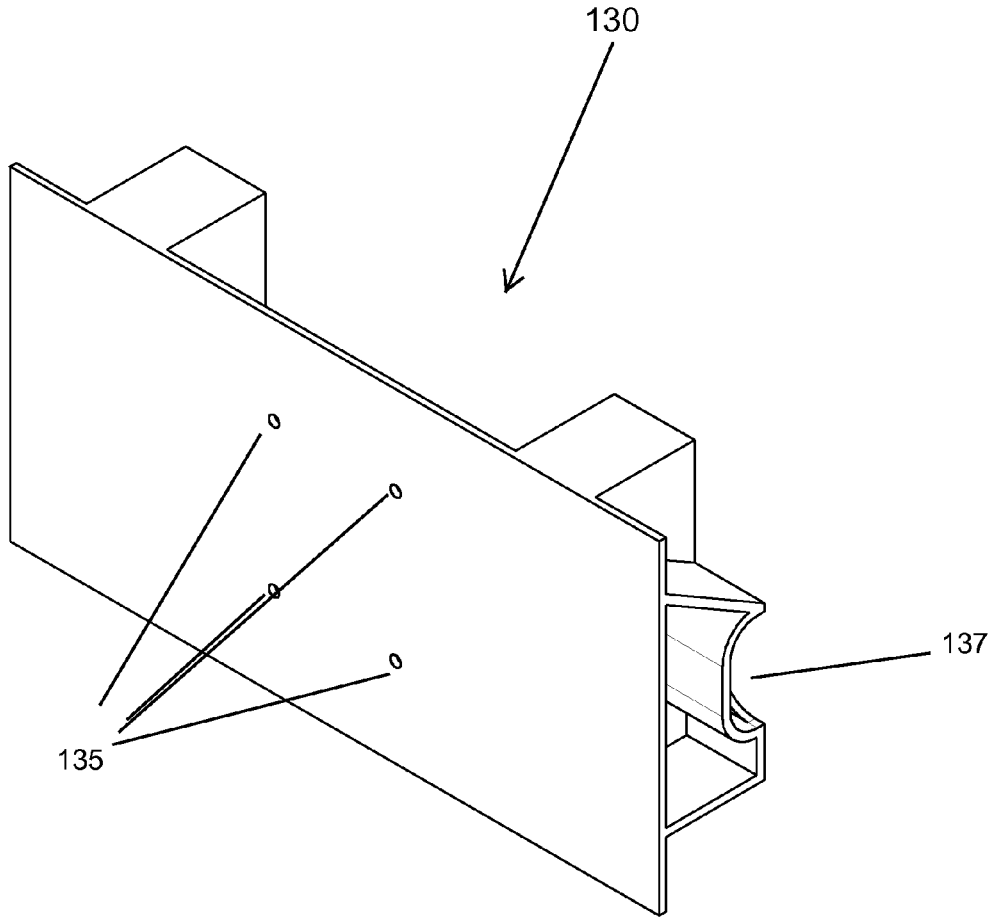
FIG. 5A is a front perspective view of a sign attachment bracket according to one embodiment of the invention.

FIG. 5A is a front perspective view of sign attachment bracket 130 comprising sign attachment bracket holes 130 and sign mounting bracket receiving cavities 137 sized to receive mounting bracket arms 127.

Figure 5B:
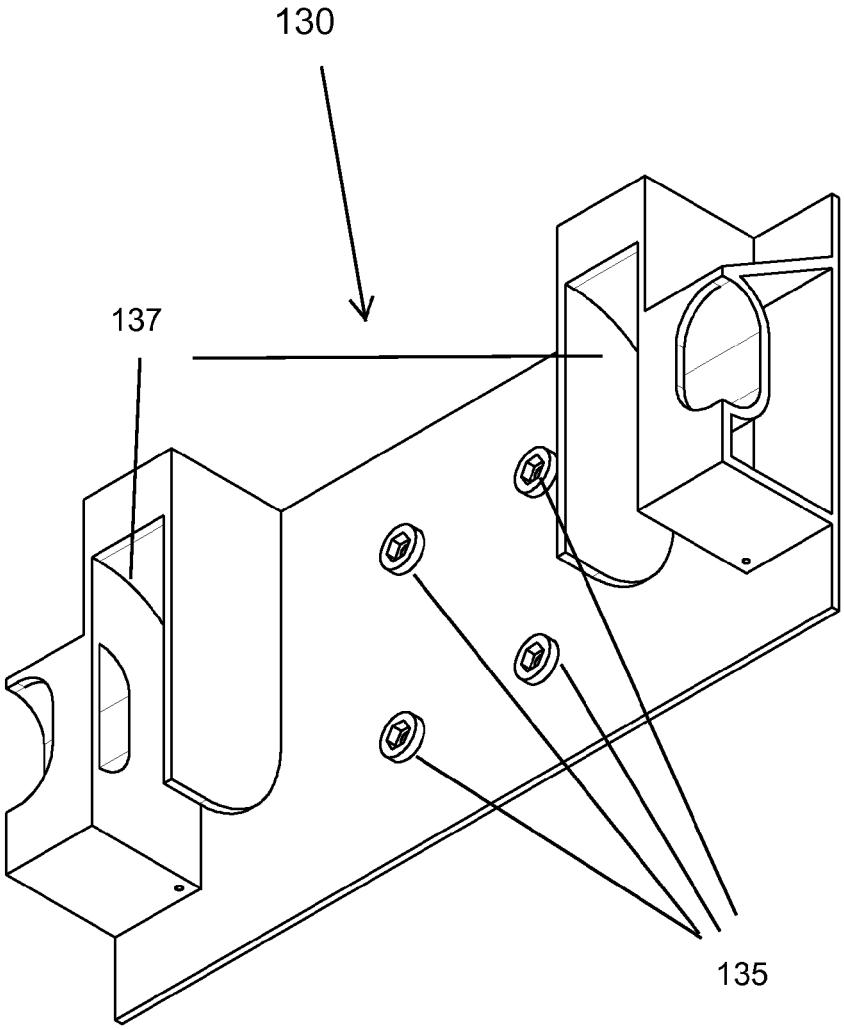
FIG. 5B is a rear perspective view of a sign attachment bracket according to one embodiment of the invention.

FIG. 5B is a rear perspective view of sign attachment bracket 130 sign attachment bracket holes 130, sign mounting bracket receiving cavities 137 sized to receive mounting bracket arms 127 and two sign mounting bracket attachment cavities 139.

Figure 6:
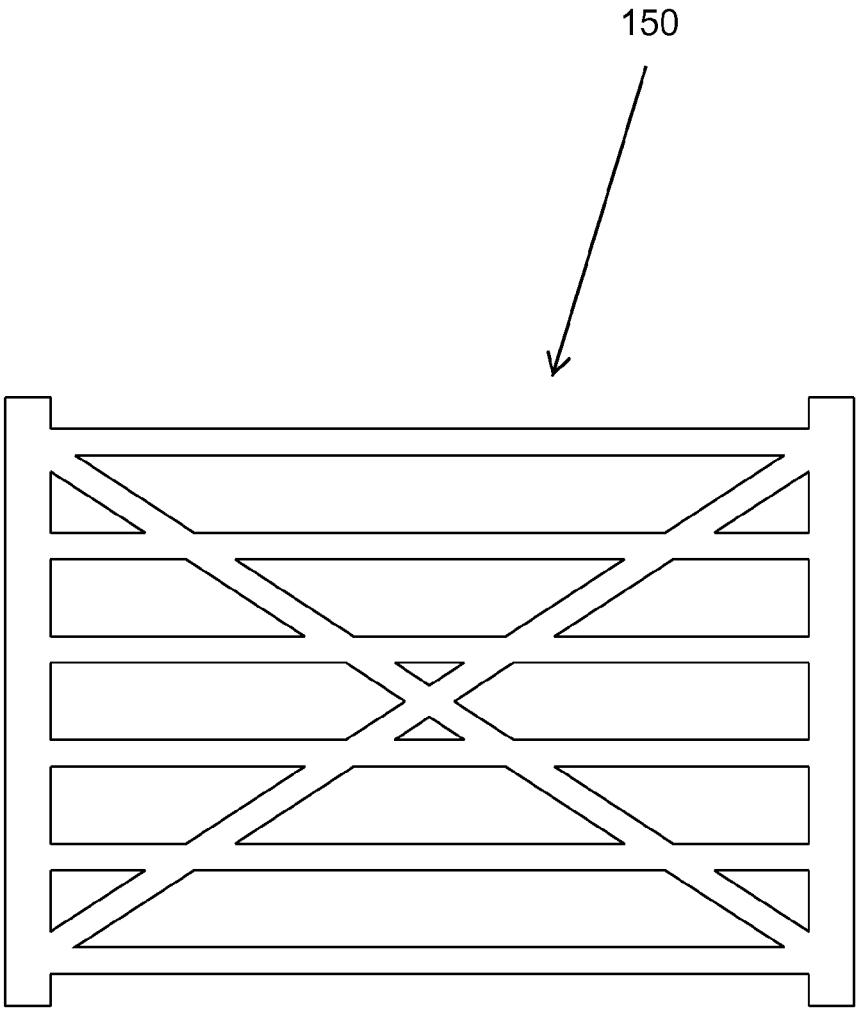
FIG. 6 is a front view of a light grate according to one embodiment of the invention.

FIG. 6 is a front view of LED light grate 150 that holds an LED strip if desired. LED strip can be powered by solar power unit 180 or else can be wired into the vehicle electrical system.

Figure 7A:
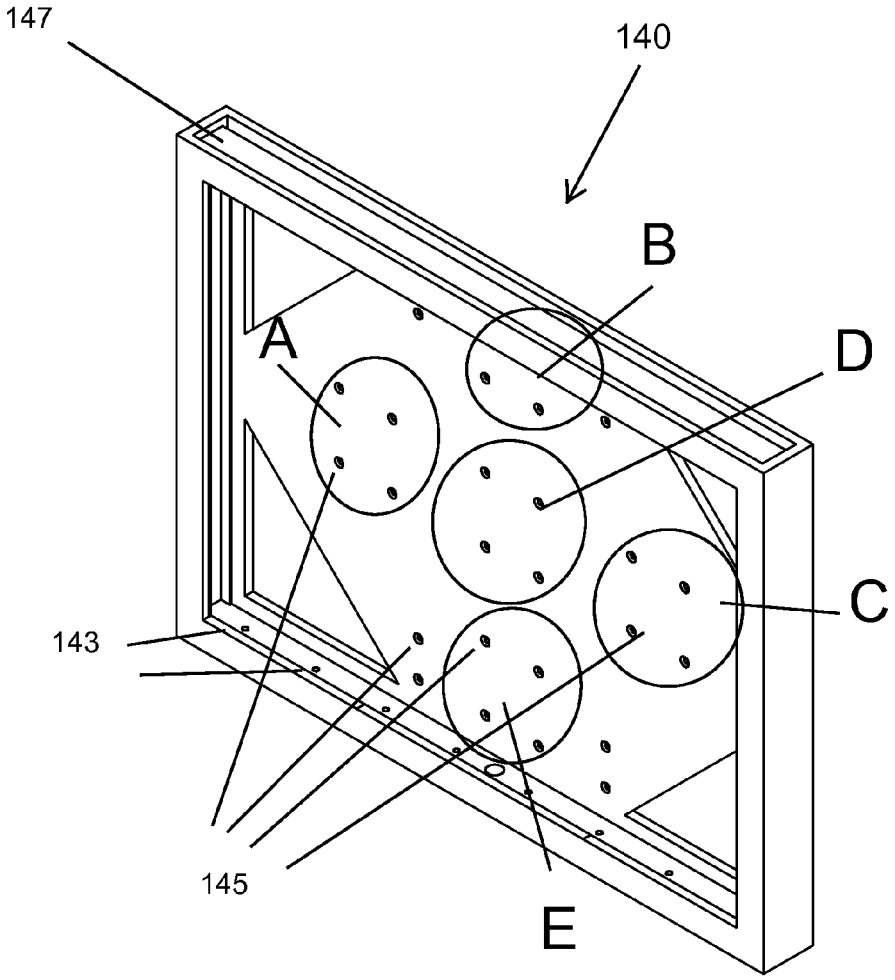
FIG. 7A is front perspective view of a sign frame according to one embodiment of the invention.

FIG. 7A is front perspective view of sign frame 140 comprising plurality of holes 145 and top sleeve opening 147. Sign frame holes 125 are arranged to provide a variety of locations for attachment of sign mounting bracket 130 as noted by the groupings A, B, C, D and E. Sign frame 130 may further comprise a plurality of weep holes 143 disposed at the bottom to allow moisture to drain.

Figure 7B:
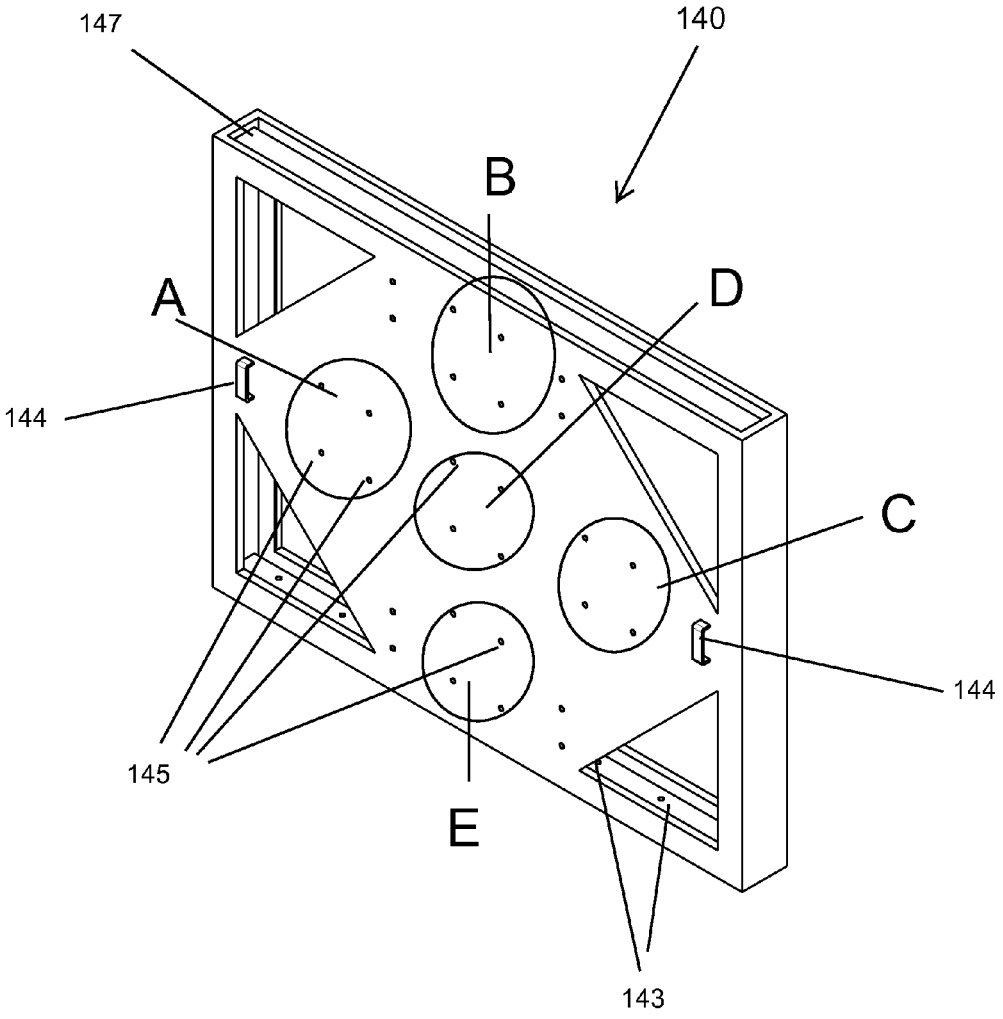
FIG. 7B is rear perspective view of a sign frame according to one embodiment of the invention.

FIG. 7B is rear perspective view of sign frame 140 comprising plurality of holes 145, top sleeve opening 147 and quick connectors 149. Certain of sign frame holes 125 are arranged to provide a variety of locations for attachment of sign mounting bracket 130 as noted by the groupings A, B, C, D and E. Sign frame 130 may further comprise a plurality of weep holes 143 disposed at the bottom to allow moisture to drain. Cable holder 144 is disposed on rear of sign frame 140.

Figure 8:
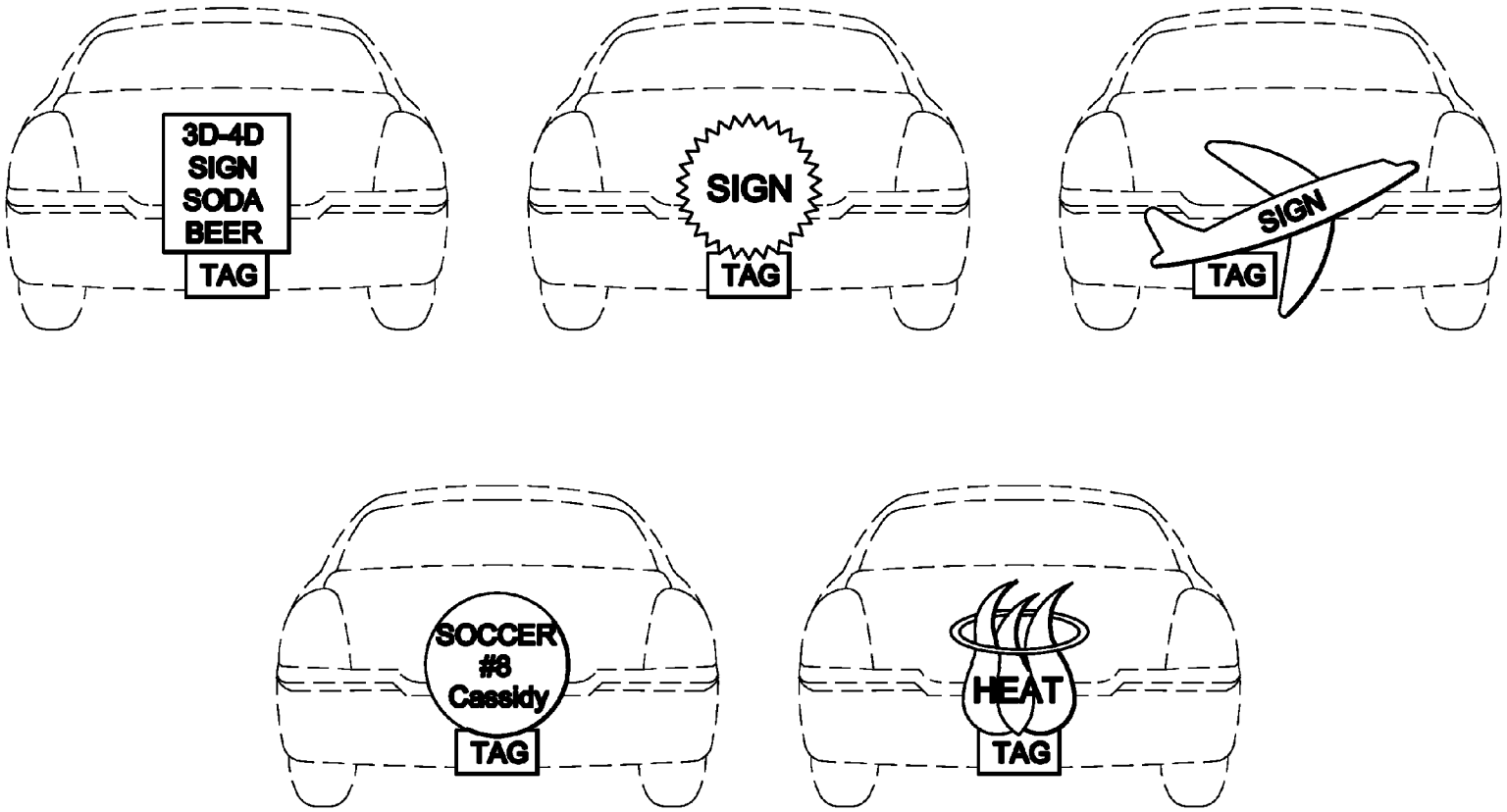
FIG. 8 depicts a variety of signs and billboards that can be used with the vehicle advertising system.

FIG. 8 depicts a variety of signs and billboards that can be used with the vehicle advertising system.

In operation, mounting bracket 120 is attached to a vehicle via screws inserted through the plurality of mounting bracket holes 125 which have been aligned with holes in the vehicle for mounting a license plate. Sign mounting bracket 130 is attached to sign frame 140 by attachment with screws inserted through sign mounting bracket holes 135 into sign frame holes 145. The connected sign mounting bracket 130 and sign frame 140 are then attached to mounting bracket 120 by slideable insertion of mounting bracket arms 127 inside sign mounting bracket receiving cavities 137 coupled with insertion of spring loaded quick connectors 149 into sign mounting bracket attachment cavities 139. Sign 110 can be inserted into top sleeve opening 147. Multiple signs 110 may be stored in sign frame 140. LED lighting bracket 150 may be inserted into sign frame 140 to light up sign 110.

License plate mounting bracket 160 is attached to sign frame 130 by mating and inserting screws through license plate mounting bracket holes 165 and sign frame holes 145. License plate holder 170 is attached to license plate mounting bracket by inserting license plate mounting bracket arms 167 into license plate holder receiving cavities 177 and slideably attaching quick connectors 149 to license plate holder receiving cavities 179. The license plate of the vehicle is secured by license plate holder in a location viewable as required by law.

When the user does not wish to use sign frame 130, license plate holder 170 can be attached directly to mounting bracket 120 by inserting mounting bracket arms 127 into license plate holder receiving cavities 177. Other connections such as quick connectors can be used to further connect license plate holder 170 and mounting bracket 120.

The location and number of the sign frame holes 145 can vary such that sign frame holder 140 can be attached to sign frame bracket 130 in a variety of configurations to accommodate a variety of sizes and shapes of signs 110.

The vehicle may comprise a car or a bus.

Signs and billboards comprising 3D or 4D art and other attachments can be configured to work with the vehicle advertising system. Signs and billboards may be commercial advertisements or may display personal messages. Signs and billboards may be lighted or not lighted as desired. Power connections may comprise quick connection to turn power on and off. Lights for the sign/billboard and/or the license plate may be powered by solar, battery or 12v car connection. The sign frame and/or the signs/billboards can comprise a magnet for certain displays such as, for example, spinning basketballs or 3D pictures. The vehicle advertising system works on any vehicle that has standard mounting holes for a license plate without modification of the vehicle.

The foregoing embodiments have been presented for the purpose of illustration and description only and are not to be construed as limiting the scope of the invention in any way.

What is claimed is:

1. A vehicle mounted advertising system comprising:

a mounting bracket comprising a plurality of mounting bracket holes configured to align with holes in a vehicle for mounting a license plate and mounting arms;

a sign mounting bracket comprising a plurality of sign mounting bracket holes, two sign mounting bracket receiving cavities sized to receive the mounting arms of the mounting bracket and two sign mounting bracket attachment cavities;

a sign frame comprising a plurality of sign frame holes and four quick connectors;

an LED lighting frame;

a license plate mounting bracket comprising a plurality of holes and two license plate mounting spring loaded quick connectors;

a license plate holder comprising two license plate mounting bracket receiving cavities sized to receive the mounting arms of the license plate mounting bracket and two license plate holder attachment cavities;

a solar power unit disposed on license plate holder; and a sign;

wherein the mounting bracket is attached to the vehicle via a plurality of screws inserted through the mounting bracket holes into the holes in the vehicle for the attachment of a license plate, wherein the sign mounting bracket is attached to the sign frame by attachment with screws inserted through the sign mounting bracket holes and the sign frame holes, wherein the attached sign mounting bracket and sign frame are attached to the mounting bracket by slideable insertion of the mounting bracket arms inside the sign mounting bracket receiving cavities and also with insertion of the spring loaded quick connectors into the sign mounting bracket attachment cavities, wherein the license plate mounting bracket is attached to the sign frame by mating and inserting screws through the license plate mounting bracket holes and the sign frame holes, wherein the license plate holder is attached to the license plate mounting bracket by inserting the license plate mounting bracket arms into the license plate holder receiving cavities and slideably attaching spring loaded quick connectors to the license plate holder attachment cavities, wherein the sign is inserted into a top sleeve opening of the sign frame.

2. The vehicle advertising system of claim 1, wherein an LED strip is mounted on the LED lighting frame.

3. The vehicle advertising system of claim 2, wherein the LED strip is powered by the solar power unit.

4. The vehicle advertising system of claim 3, wherein the solar power unit comprises a rechargeable battery.

5. The vehicle advertising system of claim 2, wherein the LED strip is powered by the 12 volt car electrical system.

* * * * *